US007165525B2

(12) United States Patent
Vogel

(10) Patent No.: US 7,165,525 B2
(45) Date of Patent: Jan. 23, 2007

(54) INTAKE SYSTEM FOR AN INTERNAL COMBUSTION ENGINE

(75) Inventor: Edgar Vogel, Gammertingen (DE)

(73) Assignee: Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 11/094,666

(22) Filed: Mar. 31, 2005

(65) Prior Publication Data

US 2005/0217635 A1 Oct. 6, 2005

(30) Foreign Application Priority Data

Mar. 31, 2004 (DE) ..... 10 2004 016 478

(51) Int. Cl.
*F02M 35/12* (2006.01)

(52) U.S. Cl. ..... 123/198 E; 123/184.57

(58) Field of Classification Search ..... 123/198 E, 123/184.57, 184.53
See application file for complete search history.

(56) References Cited

U.S. PATENT DOCUMENTS

| | | | | |
|---|---|---|---|---|
| 4,319,549 | A * | 3/1982 | Yoneda et al. | 123/198 E |
| 5,140,957 | A * | 8/1992 | Walker | 123/198 E |
| 5,424,494 | A | 6/1995 | Houle et al. | |
| 5,479,907 | A * | 1/1996 | Walker, Jr. | 123/573 |
| 5,730,769 | A * | 3/1998 | Dungs et al. | 55/385.3 |
| 6,540,801 | B2 * | 4/2003 | Gieseke et al. | 55/330 |
| 6,758,873 | B2 * | 7/2004 | Gieseke et al. | 55/330 |
| 6,881,238 | B2 * | 4/2005 | Marchart et al. | 55/495 |
| 2001/0035150 | A1 * | 11/2001 | Daly et al. | 123/198 E |
| 2004/0093859 | A1 * | 5/2004 | Schmeichel et al. | 60/299 |

FOREIGN PATENT DOCUMENTS

| | | |
|---|---|---|
| EP | 0 233 809 B1 | 8/1987 |
| EP | 0 379 926 B2 | 8/1990 |
| JP | 57 13262 A | 1/1982 |
| JP | 2002-266715 A | 1/2003 |

* cited by examiner

*Primary Examiner*—Stephen K. Cronin
*Assistant Examiner*—Jason Benton
(74) *Attorney, Agent, or Firm*—Crowell & Moring LLP

(57) ABSTRACT

An intake system for an internal combustion engine including an air filter provided with a filter housing. Areas inside the filter housing in which there is little or no air flow are designed with a shunt resonator or a lambda/4 pipe. This design is based on the fact that at least one partition is provided in the housing forming a cavity together with the exterior wall of the housing.

8 Claims, 3 Drawing Sheets

INTAKE SYSTEM FOR AN INTERNAL COMBUSTION ENGINE

BACKGROUND OF THE INVENTION

This invention relates to an intake system for an internal combustion engine provided with at least one shunt resonator and/or lambda/4 pipe.

U.S. Pat. No. 5,014,816 discloses an intake system of an internal combustion engine is provided with an air filter housing accommodating a flat filter element. Above the filter element there are a plurality of outwardly extending chambers that are designed as lambda/4 pipes. Noise reduction in certain frequencies is achieved through these chambers. The chambers require a relatively large design space, extend to the periphery of the air filter system and are very complex to manufacture.

U.S. Pat. No. 5,424,494 discloses a noise reduction system, which again uses a housing in the form of a Helmholtz resonator situated between two air intake connections. This housing extends over a larger design space. In addition to the housing, additional elements such as a lambda/4 pipe or air guide tubes are provided. The disadvantage of this device is the extensive design space which is needed for improving the acoustic properties.

SUMMARY OF THE INVENTION

It is therefore an object of the present invention to provide an improved air intake system for an internal combustion engine.

Another object of the invention is to provide an air intake system which avoids the disadvantages of the prior art.

A further object of the invention is to provide an air intake system for an internal combustion engine which can be constructed inexpensively and in a space-saving manner.

These and other objects are achieved in accordance with the present invention by providing an intake system for an internal combustion engine comprising an unfiltered air inlet, a filter element situated in a housing so as to separate an unfiltered air area of the housing from a clean air area, and a clean air outlet opening out from the clean air area of the housing, the clean air outlet being connected to the internal combustion engine, in which at least one shunt resonator or lambda/4 pipe is provided, and wherein the shunt resonator or lambda/4 pipe occupies an area of the air filter housing in which there is little or no movement of air.

Further advantageous refinements and embodiments of the invention are described in detail hereinafter.

The essential advantage of this invention is that elements such as shunt resonators or lambda/4 pipes which must usually be adapted to complex accessory parts on an intake system of an internal combustion engine may now be integrated into the filter housing.

Based on an air flow calculation, a filter housing may be divided into areas of great air movement and areas of little or no air movement. The areas of no air movement are volumes which can be utilized as shunt resonators. The advantage is that these shunt resonators can also be formed without any great effort in the manufacture of the system. In the minimum case, only an additional partition need be provided in the filter housing. Furthermore, these shunt resonators or components are not visible from the outside and therefore do not interfere with the exterior design of an intake system.

According to one embodiment of the invention, the shunt resonator may be situated on the unfiltered air side of the air filter housing, as well as on the clean air side. In both areas, there is a dead volume under some circumstances which is thus utilized.

In another embodiment, a shunt resonator is formed by an exterior wall of an air filter housing and an adjacently arranged partition which closes off the volume of the resonator relative to the remaining volume of the housing.

In one design embodiment of this invention, with an internal combustion engine having a V configuration with two air filters, two shunt resonators are provided inside the air filter housing. In many cases, the exterior contour of an intake system and/or an air filter housing is determined by the shape of the internal combustion engine, which necessarily results in cavities inside the air filter housing that can be utilized according to this invention. According to a refinement of the invention, the cavities and/or walls may be provided with additional webs or additional cavity elements, which may result in improved resonator performance as regards acoustic optimization.

According to another embodiment, a dust discharge valve or water discharge valve is situated inside the shunt resonator. This has the advantage that dust and/or water may be discharged from the filter without generating any turbulence in the constituents to be discharged.

In a refinement of this invention, the resonator is designed as a plate resonator. A plate resonator comprises a cavity between two plates, the effective frequency being adjustable through the spacing between the plates and the wall, and the number and diameter of the openings. A further improvement in the noise suppression effect may be achieved through the use of additional sound absorbing material.

These and other features of preferred embodiments of the invention, in addition to being set forth in the claims, are also disclosed in the specification and/or the drawings, and the individual features each may be implemented in embodiments of the invention either alone or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawing figures in which.

DETAILED DESCRIPTION OF PREFERRED EMBODIMENTS

Figure 1:
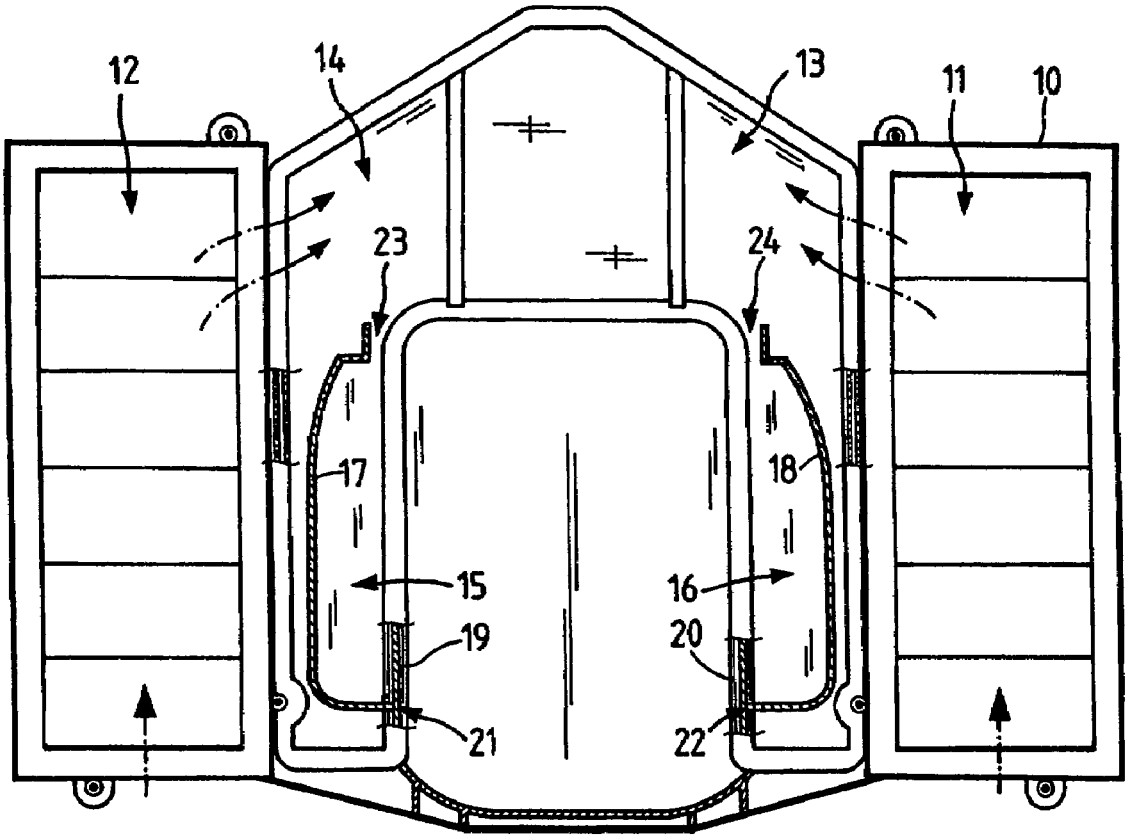
FIG. 1 is a schematic diagram of an air filter housing according to the invention.

The air filter housing shown in FIG. 1 is designed as a cover for an internal combustion engine having a V-type configuration. It has an outside contour 10 which encompasses the entire housing. The top view shows plate filter elements 11 and 12 arranged inside the contour 10. The respective unfiltered air intake is located beneath each of these plate filter elements. The incoming air is cleaned by passage through the plate filter elements and then flows into the clean air areas 13 and 14. From the clean air areas the air is directed to the cylinder banks of the internal combustion engine. Directly adjacent each of the respective plate filter elements 11 and 12 there is an area 15 or 16 in which there is no or only a very slight air flow. This housing area is determined by the outside contour 10 which is in turn necessary for design reasons. To make use of these areas, partitions 17 and 18 are provided. Partitions 17 and 18 extend approximately parallel to the inside contours 19 and 20, respectively, and are attached to these inside contours in the areas 21 and 22, respectively. On the opposite side the partition is bent back, and together with the respective inside contour 19 or 20 it forms an acoustic neck 23 or 24. To form an effective shunt resonator volume, the partition 17 or 18 is connected not only to the respective inside contour 19 or 20, but also to at least two other housing walls. The acoustic neck 23 or 24 represents the connection to the adjacent clean air area 13 or 14, respectively.

Figure 2:
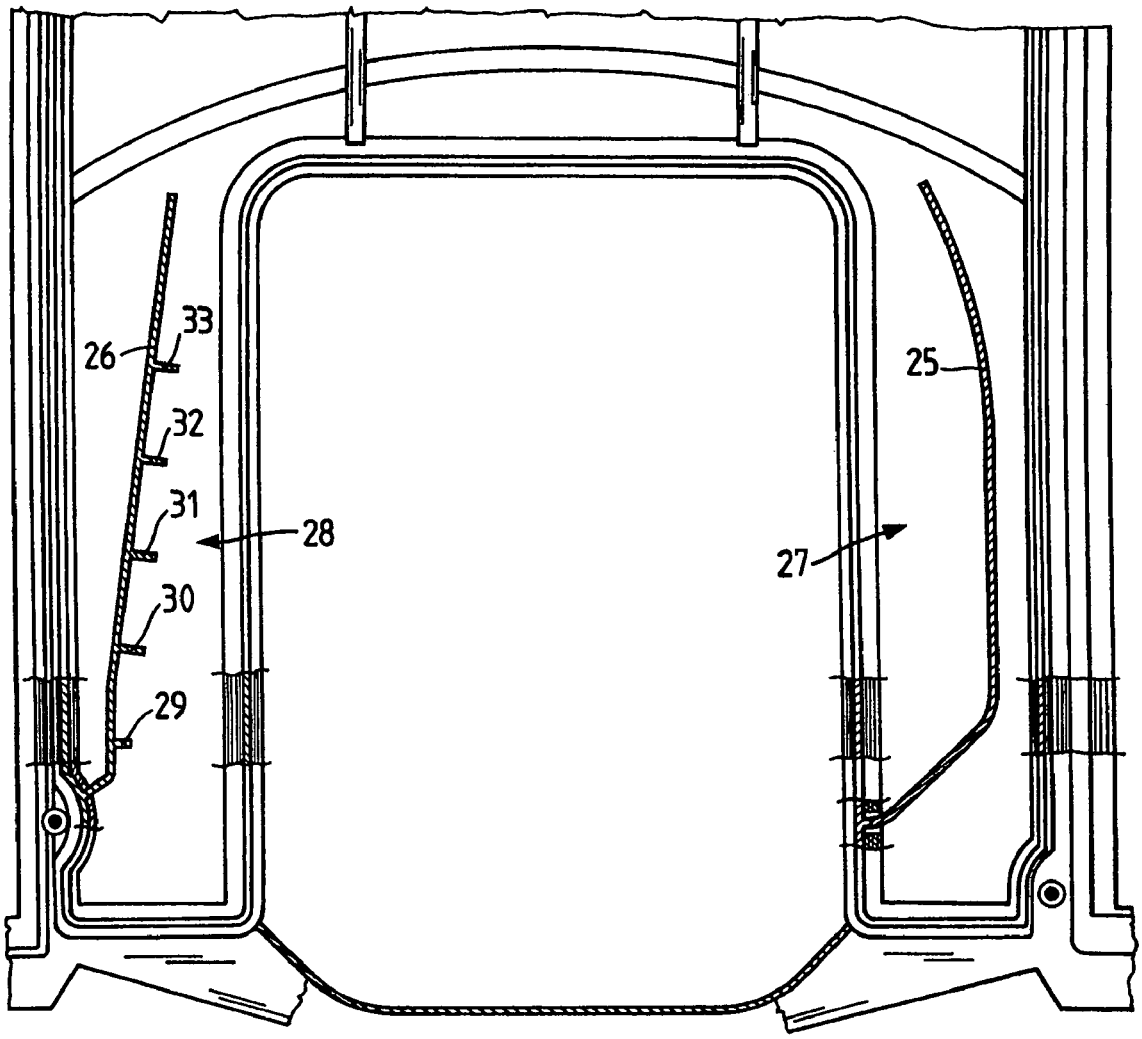
FIG. 2 is a detailed view of the air filter housing of FIG. 1.

FIG. 2 shows a detailed view of two other variants of a partition 25, 26 in which like parts are identified by the same reference numerals. The cavity 27 is designed without forming an acoustic neck. The cavity 28 has the particular feature that it contains webs 29, 30, 31, 32 and 33, which improve the acoustic properties of the shunt resonator. These webs may extend over the entire height of the partition.

Figure 3:
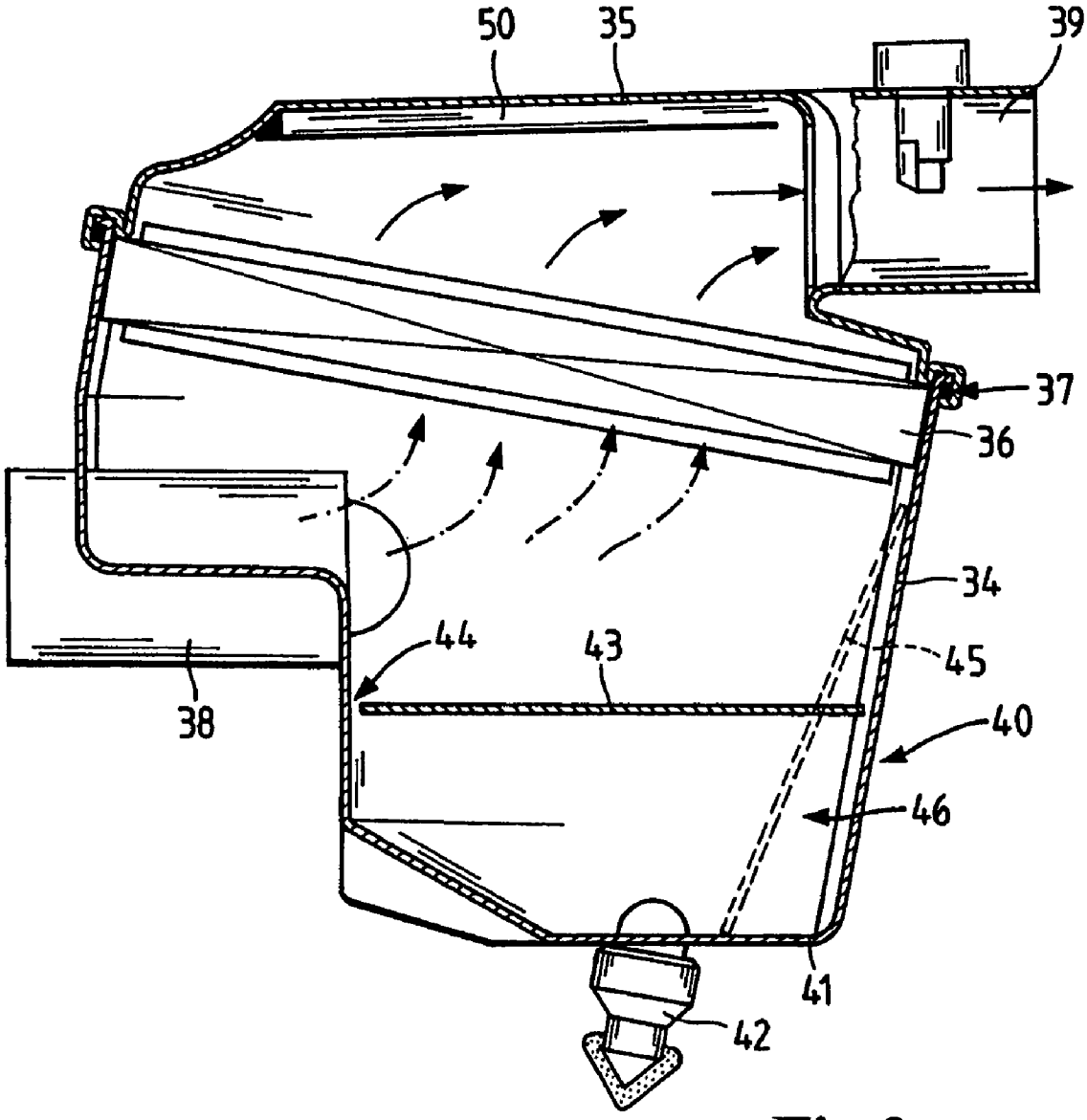
FIG. 3 is an illustration of a variant of the air guidance system according to the present invention.

FIG. 3 shows a system having a housing 34 which can be closed with a cover 35. Inside the housing there is a filter element 36 which is constructed as a plate filter element and is comprised of filter paper folded in zigzag pleats. The peripheral gasket 37 of the filter element simultaneously seals the cover 35 to the housing 34. An unfiltered air inlet 38 is situated on the housing 34. The clean air outlet 39 is situated on the cover 35. The air to be cleaned enters through the unfiltered air inlet 38, flows through the filter element and then is directed in cleaned form through the outlet 39 to an internal combustion engine (not shown). The housing 34 has a downwardly extending shape with a pot-shaped form 40 with a dust discharge valve 42 situated thereon in the bottom area 41. A partition 43 is arranged parallel to the bottom 41. Partition 43 has at least one opening 44 to the unfiltered air space of the housing 34. This opening is designed both so that the dust introduced with the unfiltered air can be conveyed to the dust discharge valve and so that an acoustic effect is achieved by the shunt resonator formed by the partition.

In another variant which is indicated here only with broken lines, a partition 45 is arranged in such a way that together with the wall of the housing 34 on the right, it forms a cavity 46 which functions as a shunt resonator.

Of course, it is also possible to not provide a partition, but instead to provide a lambda/4 pipe 50 in the area of the filter housing through which no air flows. A lambda/4 pipe 50 advantageously should have its openings near the clean air outlet. This acoustic means has the best efficiency at this location.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. An intake system for an internal combustion engine comprising an unfiltered air inlet, a filter element situated in a housing, said filter element separating an unfiltered air area of the housing from a clean air area, and a clean air outlet opening out of the housing, said clean air outlet being connected to the internal combustion engine, wherein at least one shunt resonator or lambda/4 pipe is provided, and wherein the shunt resonator or lambda/4 pipe occupies an area of the air filter housing in which there is little or no movement of air; the shunt resonator is formed by an exterior wall of the air filter housing and at least one partition which extends into the air filter housing, and the partition is provided with additional noise suppressing elements.

2. An intake system according to claim 1, wherein a shunt resonator or a lambda/4 pipe is arranged on the unfiltered air side of the air filter housing.

3. An intake system according to claim 1, wherein the shunt resonator or lambda/4 pipe is arranged on the clean air side of the air filter housing.

4. An intake system according to claim 1, wherein the internal combustion engine is a V-type engine having two air filter housing sections arranged symmetrically on the internal combustion engine, and two shunt resonators are provided inside the air filter housing.

5. An intake system according to claim 1, wherein said additional noise suppressing elements comprise webs.

6. An intake system according to claim 1, wherein said additional noise suppressing elements comprise additional cavities.

7. An intake system according to claim 1, wherein the shunt resonator is provided with a dust discharge valve or water discharge valve situated on an exterior wall of the air filter housing.

8. An intake system according to claim 1, wherein the shunt resonator is a plate resonator.

* * * * *